US006988844B2

(12) United States Patent
Maekawa et al.

(10) Patent No.: US 6,988,844 B2
(45) Date of Patent: Jan. 24, 2006

(54) PRINTER

(75) Inventors: Tomohiro Maekawa, Kanagawa (JP); Teruyasu Hanagami, Kanagawa (JP); Shogo Fujito, Kanagawa (JP); Atsushi Shiraishi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/107,562

(22) Filed: Apr. 14, 2005

(65) Prior Publication Data

US 2005/0180803 A1 Aug. 18, 2005

Related U.S. Application Data

(63) Continuation of application No. 10/295,209, filed on Nov. 15, 2002, now Pat. No. 6,945,720.

(30) Foreign Application Priority Data

Nov. 21, 2001 (JP) ..... 2001-355670

(51) Int. Cl.
*B41J 11/58* (2006.01)
*B41J 13/10* (2006.01)

(52) U.S. Cl. ..... 400/624; 400/625; 400/628; 271/207; 271/225; 271/226; 271/213

(58) Field of Classification Search ..... None
See application file for complete search history.

(56) References Cited

U.S. PATENT DOCUMENTS 4,329,046 A 5/1982 Burkett et al.
4,727,387 A 2/1988 Israely
4,740,817 A 4/1988 Suzuki et al.
4,835,567 A * 5/1989 Ogata ..... 399/124
5,106,074 A * 4/1992 Nishigaki et al. ..... 271/162
5,139,252 A 8/1992 Morita et al.
5,270,841 A 12/1993 Watanabe
5,662,320 A * 9/1997 Fujiwara et al. ..... 271/3.14
5,897,110 A 4/1999 Fujiwara
6,104,464 A 8/2000 Adachi et al.
6,567,148 B1 5/2003 Akiyama et al.

FOREIGN PATENT DOCUMENTS

JP 2000-275672 10/2000
JP 2001-194679 7/2001

* cited by examiner

*Primary Examiner*—Andrew H. Hirshfeld

*Assistant Examiner*—Marissa Ferguson

(74) *Attorney, Agent, or Firm*—Robert J. Depke; Trexler, Bushnell, Giangiorgi, Blackstone & Marr, Ltd.

(57) ABSTRACT

A printer includes a transporting block, a printing block, a positioning block, and an intermediate picking-up device. The positioning block is disposed between the transporting block and the printing block, and positions printing sheets transported by the transporting block at a predetermined location one at a time, so that they are positioned one at a time at a printing location of the printing block where printing is performed on the printing sheets. The intermediate picking-up means picks up the printing sheets positioned at the predetermined location in the positioning block one at a time in order to transport the printing sheets to the printing block.

1 Claim, 15 Drawing Sheets

PRINTER

The subject matter of application Ser. No. 10/295,209 is incorporated herein by reference. The present application is a continuation of U.S. application Ser. No. 10/295,209, filed Nov. 15, 2002 now U.S. Pat. No. 6,945,720, which claims priority to Japanese Patent Application NoJP2001-355670, filed Nov. 21, 2001. The present application claims priority to these previously filed applications.

BACKGROUND OF THE INVENTION

1. Field of the Invention

The present invention relates to a printer. More specifically, the present invention relates to the technological field of a printer comprising a sheet-holding block which can hold a plurality of printing sheets in a stack, a picking-up block for picking up the printing sheets held by the sheet-holding block one sheet at a time, a transporting block for transporting the printing sheets that have been picked up by the picking-up block, a printing block for performing printing on the printing sheets that have been transported by the transporting block, and a sheet-discharging block for discharging the printing sheets that have been subjected to printing at the printing block.

2. Description of the Related Art

There are printers which perform a printing operation on a printing sheet, such as printing paper or a printing film, by, for example, heat transfer or laser. Such a printer ordinarily comprises a sheet-holding block which can hold a plurality of printing sheets in a stack, a picking-up block for picking up the printing sheets held by the sheet-holding block one sheet at a time, a transporting block for transporting the printing sheets that have been picked up by the picking-up block, a printing block for performing printing on the printing sheets that have been transported by the transporting block, and a sheet-discharging block for discharging the printing sheets that have been subjected to printing by the printing block. In the printer, each of the blocks is disposed inside a housing.

There is a printer of what is called a horizontally-setting type which can be set horizontally so that a printing sheet is transported from the sheet-holding block to the sheet-discharging block with the surface of the printing sheet being faced vertically, and a printer of a horizontally-setting-and-vertically-setting type which can be set horizontally and which can be vertically so that a printing sheet is transported from the sheet-holding block to the sheet-discharging block with the surface of the printing sheet being faced horizontally.

Such a horizontally-setting-and-vertically-setting type can be set in accordance with the space of an installation place, so that it can be installed more freely at the installation place, thereby making it easier to use.

When the printer can be set vertically, installation area can be reduced. In particular, when computed tomography (CT) is carried out at a hospital, a large setting area is not required, so that the printer can be set as an accessory of a shooting device or as an accessory of a computer in a medical examination room. Therefore, this type of printer makes it possible to carry out medical work more quickly and simply.

However, in the related printer, printing sheets are successively transported by a plurality of transport rollers, etc., in the process of transporting them to the printing block by the transporting block by picking them up by the picking-up block from the sheet-holding block, so that the position of the printing sheets transported to the printing block may be shifted with respect to the position of the printing sheets picked up from the sheet-holding block.

When such a shift in position occurs, a missing image results because an image is no longer printed onto the entire sheet at the printing block, a shift in the orientation of an image with respect to the printing sheet occurs, etc.

In the sheet-holding block, a plurality of printing sheets are held in a stack. When the printing sheets are held by the sheet-holding block in a warped state, problems such as the printing sheets being improperly picked up by the picking-up block or the printing sheets being damaged when they are picked up by the picking-up block may occur.

The problems of shifts in the position of the printing sheets and warping of the printing sheets tend to occur particularly when the printer is vertically set so that the printing sheets are transported with their surfaces being faced horizontally.

In the horizontally-setting-and-vertically-setting type which performs a printing operation by scanning a printing sheet by a printing head pushed against a platen roller with the printing sheet being interposed therebetween, the pressures upon the printing sheet when the printer is set horizontally and when the printer is set vertically are different due to the effects of the weight of the printing head. Therefore, when printing is performed with the pressures being different, a printing failure may occur in either one of the horizontally set and vertically set states.

SUMMARY OF THE INVENTION

Accordingly, a printer of the present invention makes it possible to overcome the above-described problems in order to make each block operate properly and to prevent printing failure.

To this end, according to one aspect of the present invention, there is provided a printer wherein a positioning block is disposed between a transporting block and a printing block and positions printing sheets transported by the transporting block at a predetermined location of the positioning block one at a time so that they are positioned one at a time at a printing location of the printing block where each printing sheet is subjected to printing; and wherein intermediate picking-up means for picking up the printing sheets positioned at the predetermined location in the positioning block one at a time in order to transport the printing sheets to the printing block is provided.

Therefore, in the printer of the present invention, the printing sheets that have been transported by the transporting block are positioned just before they are transported into the printing block.

To this end, the sheet-holding block may comprise a sheet-receiving plate for receiving one of the surfaces of each printing sheet held in the sheet-holding block, and holding means, disposed opposing the sheet-receiving plate and moving away from the sheet-receiving plate depending upon the thickness of the printing sheets held in the sheet-holding block, for holding the other surface of each printing sheet, the other surface being opposite to the one surface.

Therefore, in the printer of the present invention, the printing sheets are held in the sheet-holding block with the printing sheets being held between the sheet-receiving plate and the holding means.

To this end, according to another aspect of the present invention, there is provided a printer further comprising state recognizing means for recognizing the vertically set state or the horizontally set state, wherein, when printing sheets are transported from a sheet-holding block to a sheet-discharging block, the pressure exerted upon the printing sheets by each component part pushed against the printing sheets is made substantially constant in accordance with the results of the recognizing operation of the state recognizing means.

Therefore, in the printer of the present invention, the printing sheets are transported with a substantially constant pressure being exerted upon the printing sheets in both the vertically set state and the horizontally set state.

DESCRIPTION OF THE PREFERRED EMBODIMENT

Hereunder, a description of an embodiment of the present invention will be given with reference to the attached drawings.

A printer of the embodiment of the present invention described below is used at, for example, a hospital and is a thermal head printer for printing image data obtained by computed tomography (CT) onto a printing film (printing-sheet) by heat transfer using a thermal head.

A printer 1 is a horizontally-setting-and-vertically-setting type which can be set horizontally so that a printing sheet is transported with its surface being faced vertically and which can be set vertically so that a printing sheet is transported with its surface being faced horizontally. In the description below, the printer 1 is set vertically.

Since the printer 1 can be set both horizontally and vertically as mentioned above, it can be set in accordance with the space of an installation place, so that it can be set more freely at the installation place.

Figure 1:
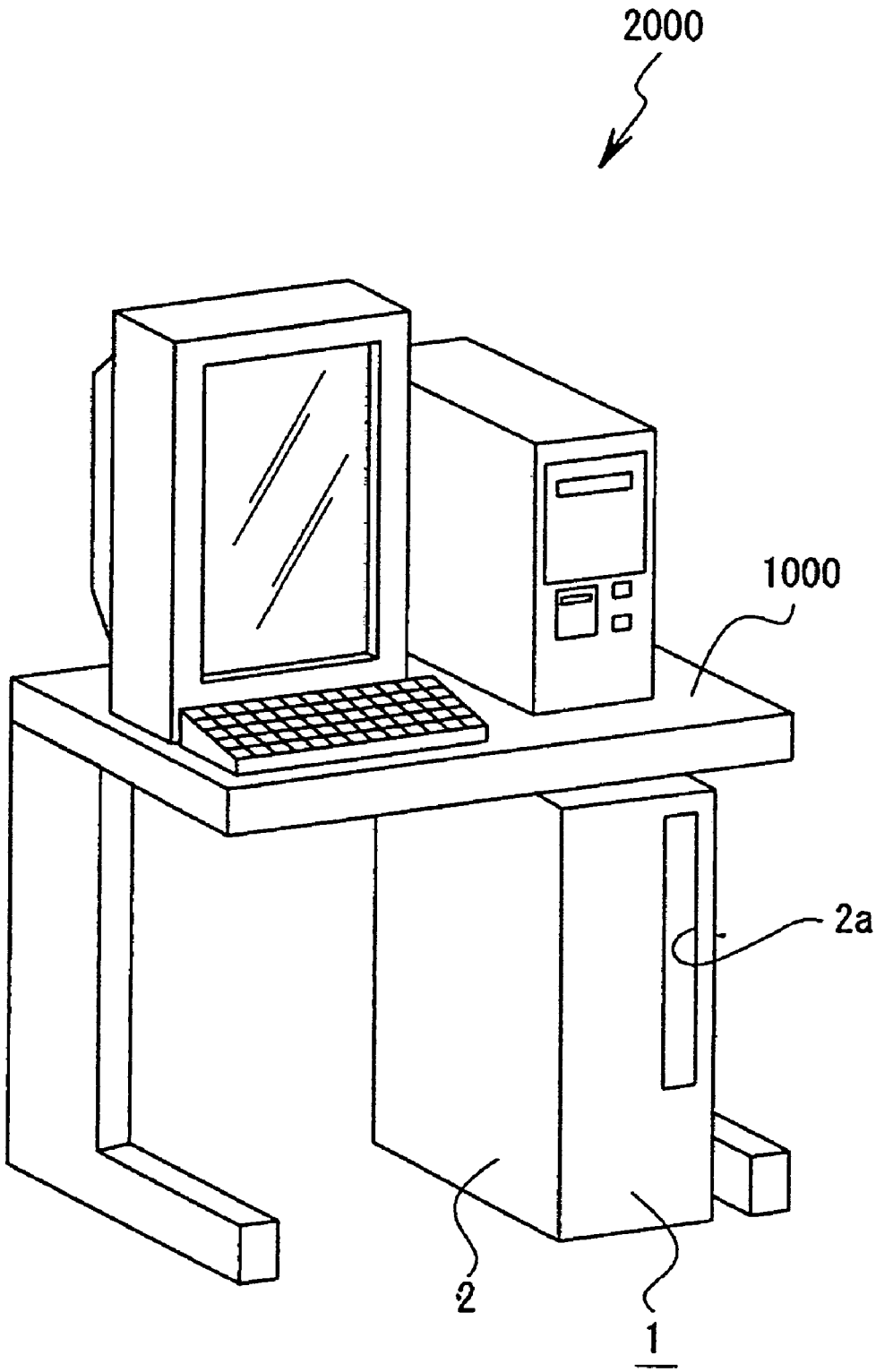
FIG. 1 illustrates an embodiment of a printer of the present invention along with FIGS. 2 to 15, and is a schematic perspective view showing an example of a set state of the printer.

Since a large installation space is not required when the printer 1 is set vertically, the printer 1 can be set, for example, below a personal computer 2000 set on a personal computer table 1000. (See FIG. 1.)

Figure 2:
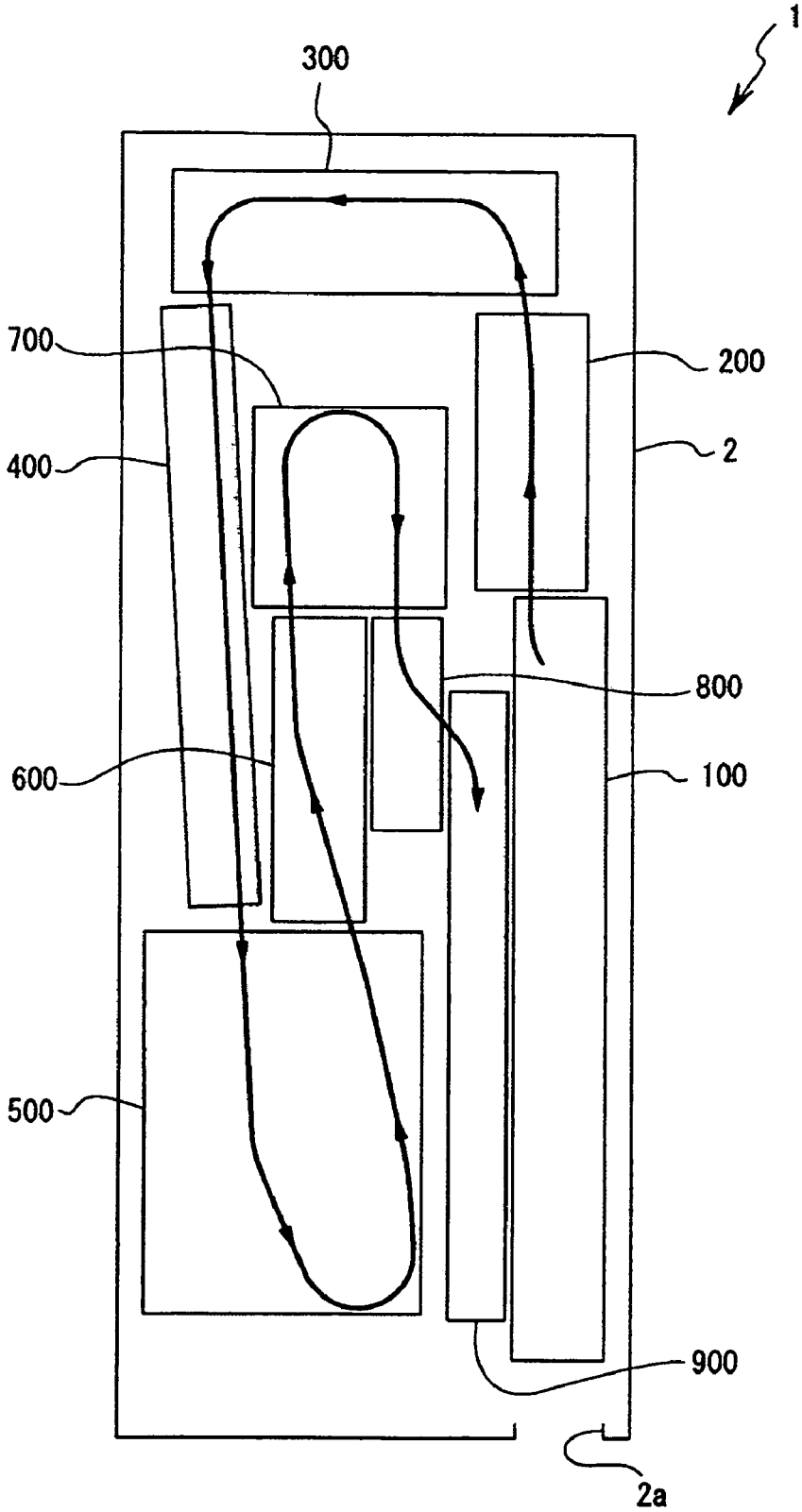
FIG. 2 is a conceptual view showing each block of the printer and a printing sheet transporting path in the printer.

The printer 1 has a structure in which required blocks, a sheet-holding block 100, a picking-up block 200, a transporting block 300, a positioning block 400, a printing block 500, an intermediate transporting block 600, a density measuring block 700, a sheet-discharging block 800, and a sheet taking-out block 900, are disposed inside a housing 2. (See FIG. 2.)

In the printer 1, printing sheets 3000 are picked up from the sheet-holding block 100 by the picking-up block 200, and are transported to the sheet taking-out block 900 through the transporting block 300, the positioning block 400, the printing block 500, the intermediate transporting block 600, the density measuring block 700, and the sheet-discharging block 800. (See FIG. 2.)

An opening 2*a* for inserting and taking out the sheet-holding block 100 is provided in the front surface of the housing 2. (See FIGS. 1 to 3.)

The sheet-holding block 100 is disposed at the right end portion inside the housing 2 (see FIG. 2), and has a flat, box-shaped sheet cassette 3 which is long in the forward-and-backward direction. (See FIGS. 3 to 6.)

The sheet cassette 3 is removable from the housing 2, and has a case member 4 having an open left side and a cover member 5 which covers the opening of the case member 4. (See FIGS. 3 to 5.) A sheet picking-up opening 3*a* is provided in the back end portion of the sheet cassette 3.

The cover member 5 has the shape of a flat plate, and is provided as a sheet-receiving plate for receiving one of the surfaces of each printing sheet 3000 inside the sheet cassette 3. Rollers 6 and 6, which are spaced apart in the forward-and-backward direction and which are long in the vertical direction, are rotatably supported at the inside surface of the cover member 5. (See FIGS. 3 and 5.)

A holding plate 7, serving as holding means for holding the other surface of each printing sheet 3000, is supported inside the sheet cassette 3 so as to be movable towards the left and right. (See FIGS. 3, 5, and 6.) The holding plate 7 is formed into the shape of a flat plate, is disposed opposing the cover member 5, and is formed with approximately the same size as or one size larger than the printing sheets 3000.

An adjusting mechanism 8 is disposed between a right surface 4*a* of the case member 4 and the holding plate 7. (See FIG. 6.) The adjusting mechanism 8 comprises a drive motor 9, a worm gear 10, a main gear 11., driven gears 12 and 12, rack members 13 and 13, and pairs of adjusting gears 14, and is a mechanism for moving the holding plate 7 away from the cover member 5 depending upon the thickness of the printing sheets 3000 held in a stack inside the sheet cassette 3.

The drive motor 9 is mounted to the front end portion of the case member 4, with the worm gear 10 being secured to the shaft of the drive motor 9.

The main gear 11 is a two-speed gear comprising a small-diameter portion 11*a* and a large-diameter portion 11*b*, with the large-diameter portion 11*b* engaging the worm gear 10.

The driven gears 12 and 12 are two-speed gears, each comprising a large-diameter portion 12*a* and a small-diameter-portion 12*b*. The large-diameter portions 12*a* and 12*a* engage the small-diameter portion 11*a* of the main gear 11.

The rack members 13 and 13 are supported on a top surface 4*b* and a bottom surface 4*c* of the case member 4, respectively, so as to be movable in the forward-and-backward directions. Main rack portions 13*a* and 13*a*, which are long in the forward-and-backward directions, and protruding plate portions 13*b* and 13*b*, which protrude towards each other from the forward-and-backward-direction central portions of the rack members 13, are integrally formed. Racks 13*c* and 13*c* are formed at the front edges of the respective protruding plate portions 13*b* and 13*b*, with the small-diameter portions 12*b* and 12*b* of the driven gears 12 and 12 engaging the respective racks 13*c* and 13*c*.

In each adjusting gear 14, a disc portion 14*a*, a geared portion 14*b*, provided on one surface of the disc portion 14*a*, and a cam protruding portion 14*c*, protruding from the other surface of the disc portion 14*a*, are integrally formed, with the cam protruding portions 14*c* being formed on the outer peripheral portions of the respective disc portions 14*a*. With the pairs of adjusting gears 14 being supported, one pair on the top surface 4*b* and the other pair on the bottom surface 4*c* of the case member 4, and with the adjusting gears 14 of each pair being separated from each other in the front and back, the pairs of geared portions 14*b* engage the main rack portions 13*a* of their respective rack members 13.

The cam protruding portions 14*c* of each pair of adjusting gears 14 slidably engage the top and bottom edges of the holding plate 7, disposed inside the case member 4, from the right side, respectively.

In the adjusting mechanism 8, when the drive motor 9 rotates, the driving force thereof is transmitted to the worm gear 10, the main gear 11, the driven gears 12 and 12, the rack members 13, and the adjusting gears 14 in that order, causing the adjusting gears 14 rotate, so that the cam protruding portions 14*c* change their positions. Therefore, the rotation of the adjusting gears 14 causes the holding plate 7 engaging the cam protruding portions 14*c* to move horizontally, that is, in the direction in which the holding plate 7 moves away from the cover member 4.

Figure 3:
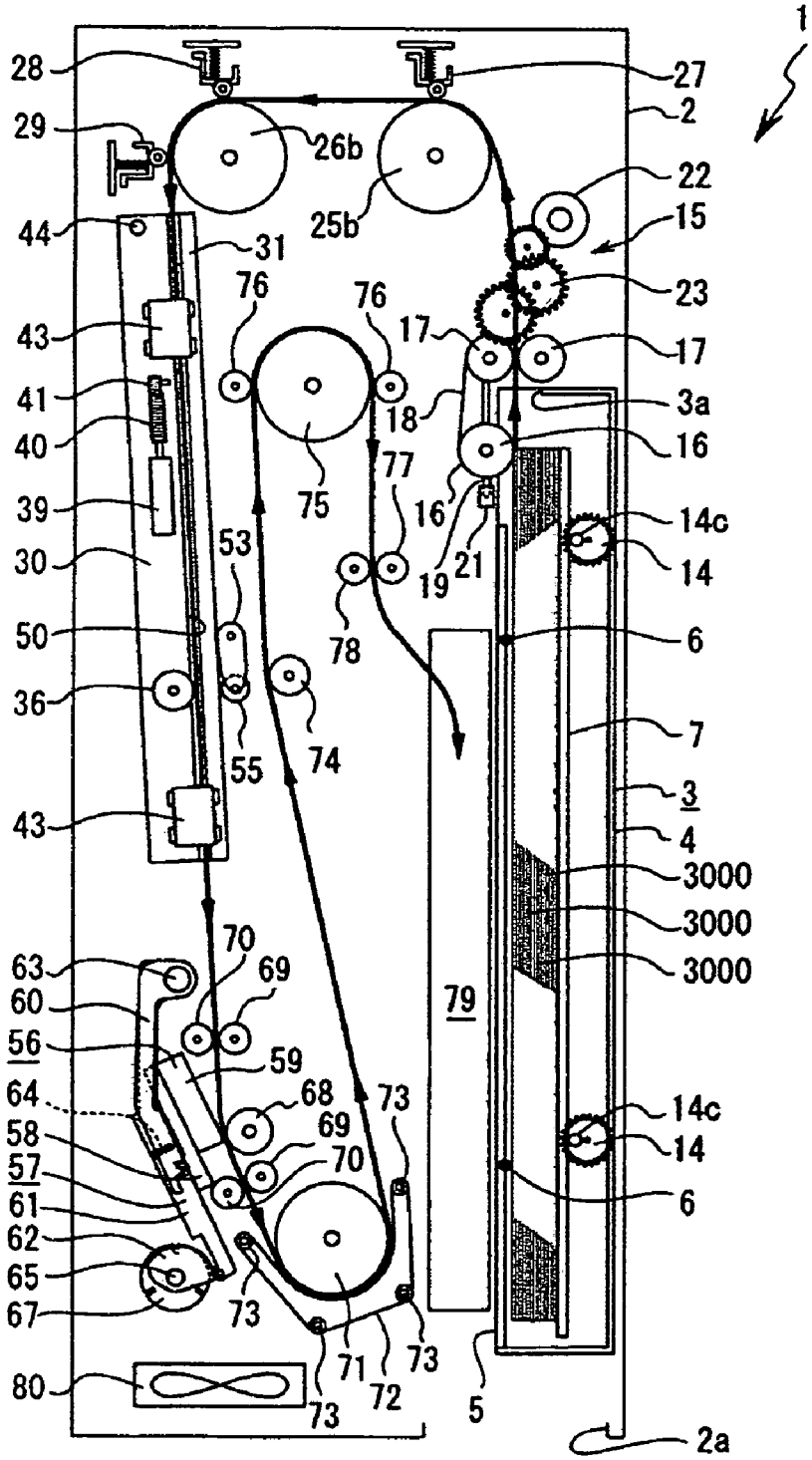
FIG. 3 is a schematic plan view of the printer.
Figure 4:
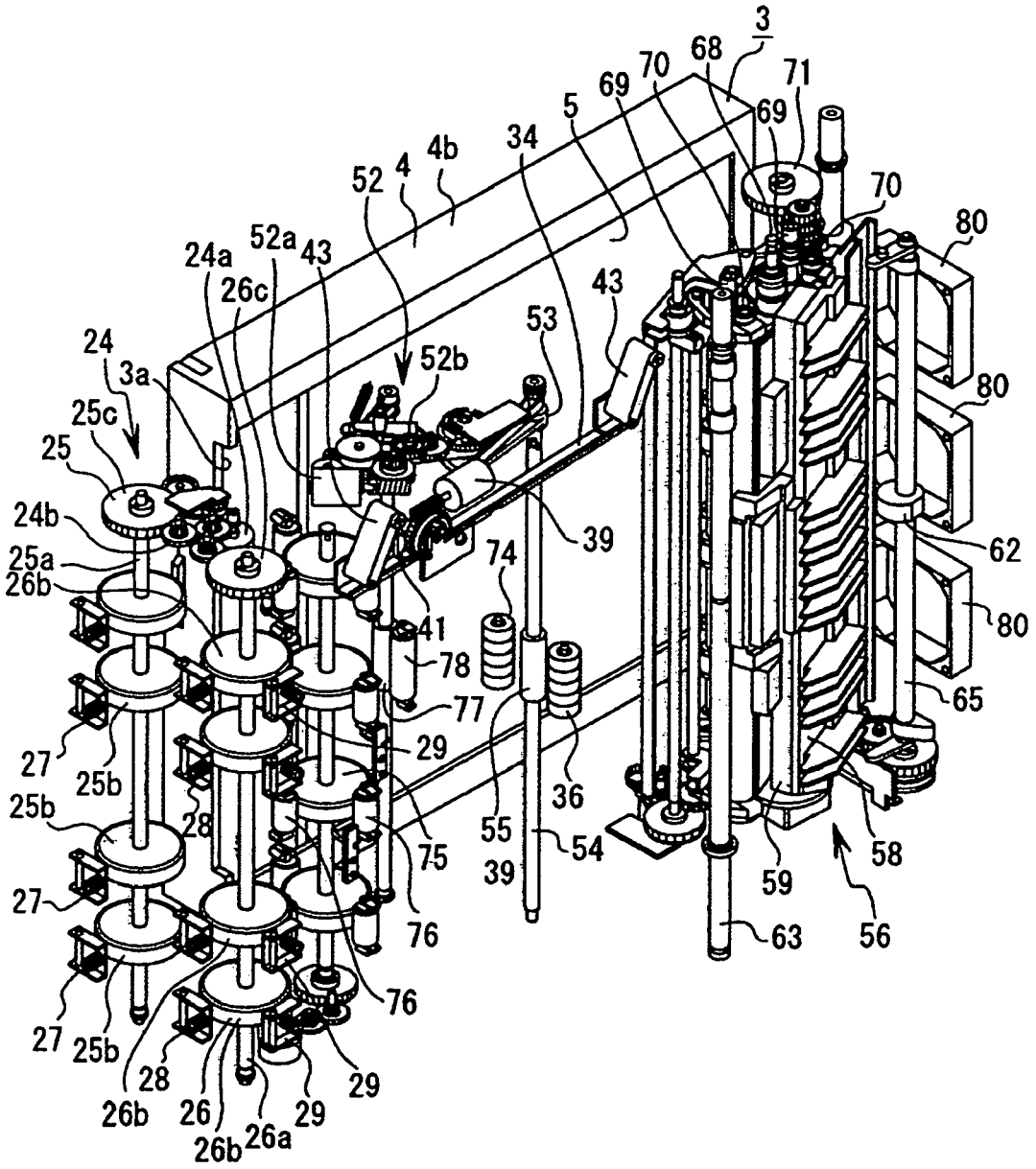
FIG. 4 is a schematic perspective view of the internal structure of the printer.
Figure 5:
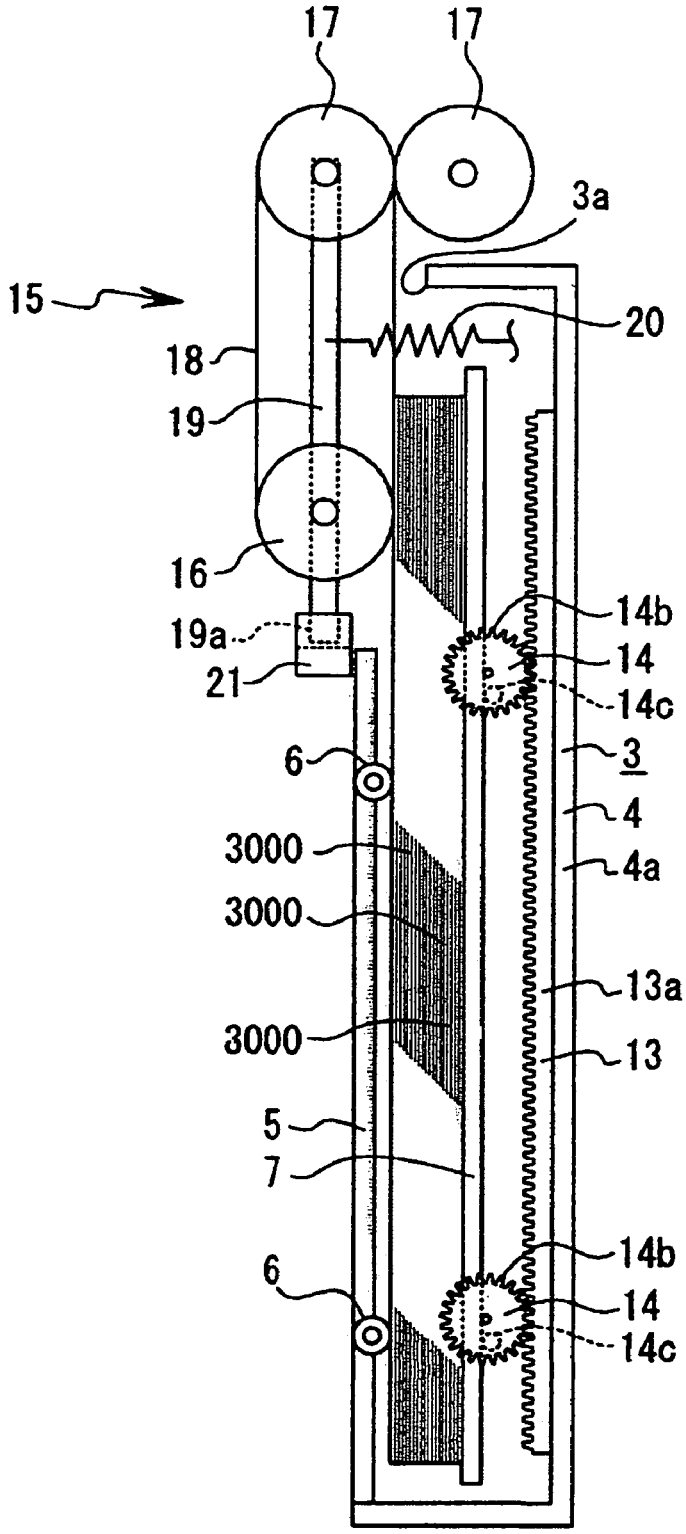
FIG. 5 is a schematic plan view of the internal structure of a sheet cassette and a picking up mechanism.
Figure 6:
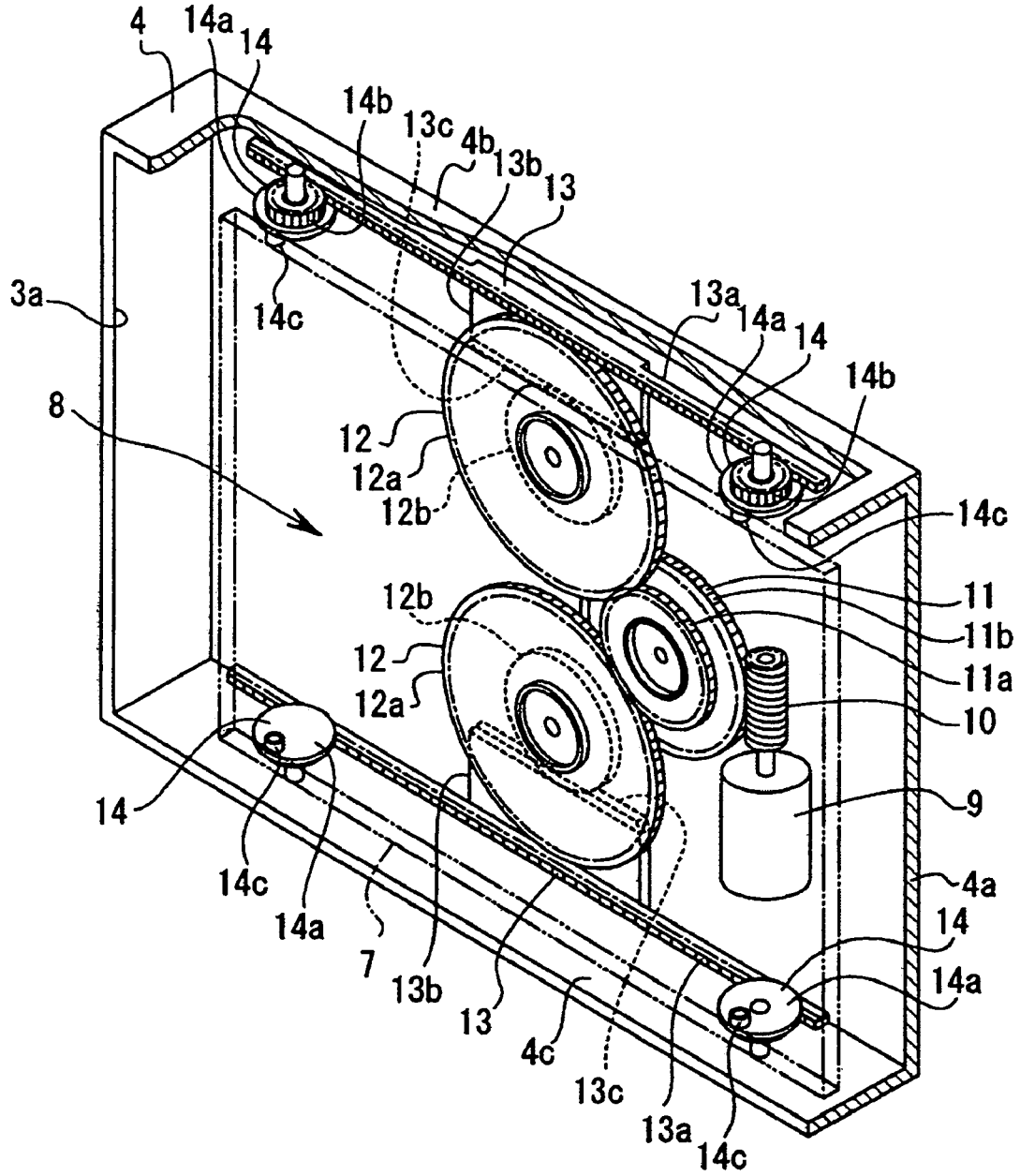
FIG. 6 is a perspective view of an adjusting mechanism provided at the sheet cassette.

The picking-up block 200 is disposed behind the sheet-holding block 100 (see FIG. 2), and has a picking-up mechanism 15 for picking up the printing sheets 3000 inside the sheet cassette 3 one at a time (see FIGS. 3 to 5).

The picking-up mechanism 15 has a pick-up roller 16. The pick-up roller 16 is linked to one of a pair of separation rollers 17 and 17, supported behind the pick-up roller 16, by a timing belt 18.

A detection member 19 is provided so as to link the rotary shaft of the pick-up roller 16 and the rotary shaft of the separation roller-17, which are linked to each other by the timing belt 18. A detection portion 19*a* of the detection member 19 protrudes forwardly of the pick-up roller 16. (See FIG. 5.). The detection member 19 is biased towards the right surface 4*a* of the case member 4 by a biasing spring 20, and the pick-up roller 16 is pushed against the printing sheets 3000 held inside the sheet cassette 3.

The detection portion 19*a* of the detection member 19 is detected by a roller position sensor 21 in order to detect the position of the pick-up roller 16 based on the detection result.

A pick-up motor 22 is disposed behind the separation rollers 17, and a gear group 23 is supported between the separation rollers 17 and the pick-up motor 22. (See FIG. 3.)

In the picking-up mechanism 15, when the pick-up motor 22 is rotated, the driving force is transmitted to the gear group 23, the separation rollers 17, and the pick-up roller 16 in that order, so that the pick-up roller 16 rotates, causing the printing sheets 3000 to be picked up from the sheet cassette 3. Then, the picked up sheets pass between the separation rollers 17, and are sent towards the transporting block 300.

The transporting block 300 is disposed at the back end of the inside of the housing 2 (see FIG. 2), and has a rotationally driving portion 24, a first rotary member 25, and a second rotary member 26. (See FIGS. 3 and 4.)

The rotational drive portion 24 has a transportation motor 24*a* and a gear group 24*b* which is rotated by the transportation motor 24*a*. (See FIG. 4.)

The first rotary member 25 comprises a vertically extending shaft 25*a*, transportation rollers 25*b*, spaced apart in the axial direction of the shaft 25*a*, and a drive gear 25*c*, provided at one end of the shaft 25*a*. The drive gear 25*c* engages one of the gears of the gear group 24*b*. When the gear group 24*b* is rotated by the rotation of the transportation motor 24*a*, the drive gear 25*c* is rotated. The rotation of the drive gear 25*c* causes the shaft 25*a* and the transportation rollers 25*b* to rotate integrally.

Presser members 27 are disposed at the outer peripheral surfaces of the respective transportation rollers 25*b* so as to oppose them, and are pushed against the respective transportation rollers 25*b* by springs.

The second rotary member 26 comprises a vertically extending shaft 26*a*, transportation rollers 26*b*, spaced apart in the axial direction of the shaft 26*a*, and a drive gear 26*c*, provided at one end of the shaft 26*a*. The drive gear 26*c* engages one of the gears of the gear group 24*b*. When the gear group 24*b* is rotated by the rotation of the transportation motor 24*a*, the drive gear 26*c* is rotated. The rotation of the drive gear 26*c* causes the shaft 26*a* and the transportation rollers 26*b* to rotate integrally. Therefore, the first rotary member 25 and the second rotary member 26 rotate in synchronism.

Presser members 28 and presser members 29 are spaced apart and disposed at the outer peripheral surfaces of the respective rollers 26*b* in the peripheral direction of the transportation rollers 26*b* so as to oppose them. The presser members 28 and the presser members 29 are pushed against the transportation rollers 26*b* by springs.

Figure 7:
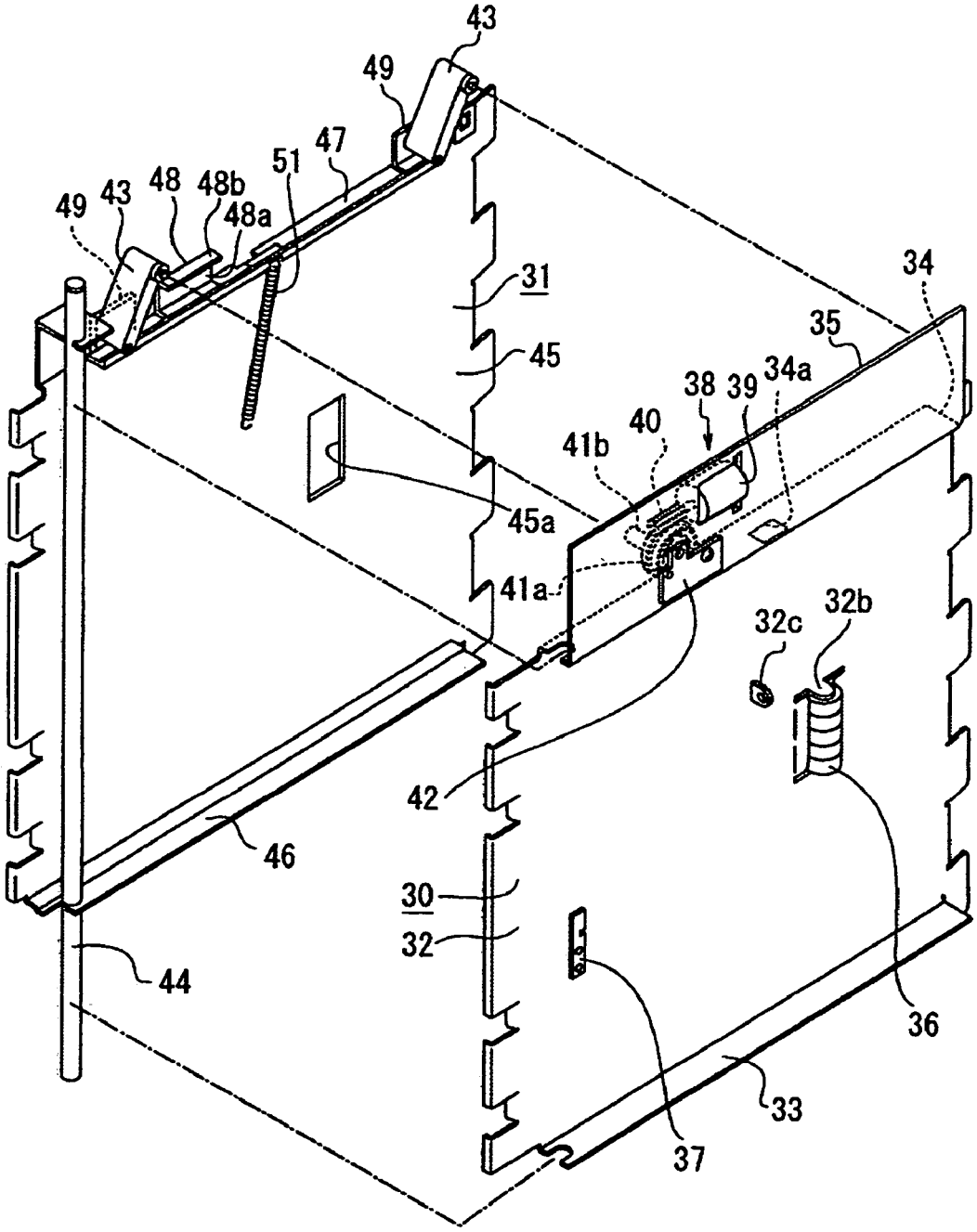
FIG. 7 is an exploded perspective view of the structure of a positioning block.
Figure 8:
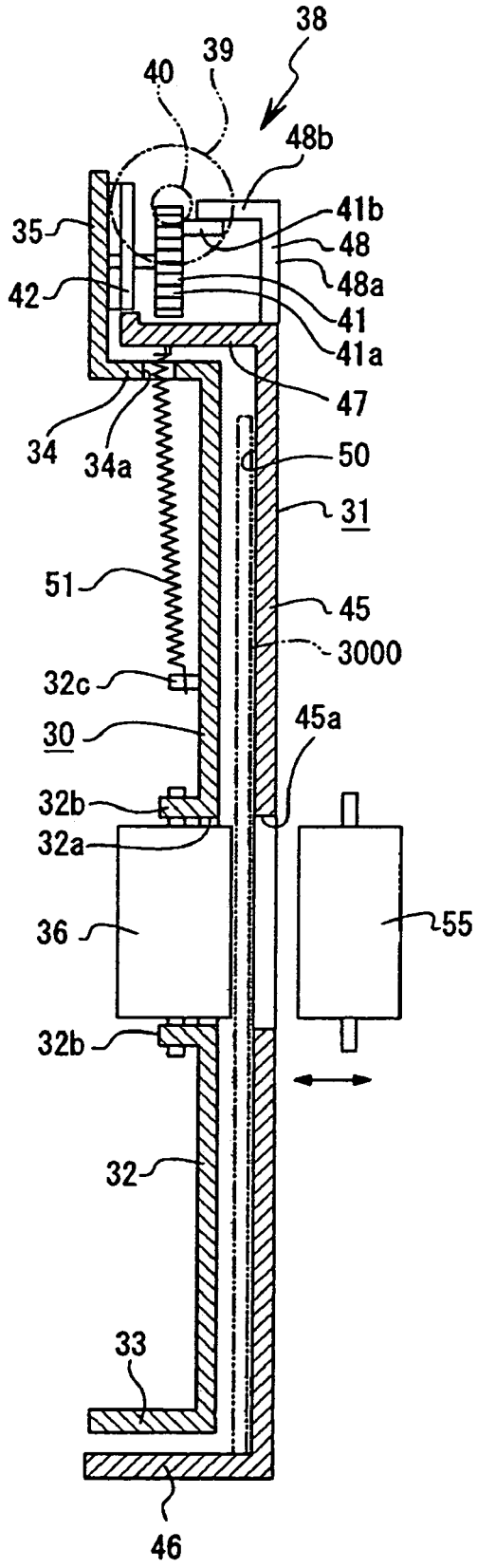
FIG. 8 is a sectional view showing the relationship between the positions of a stationary base plate and a movable base plate.

The positioning block 400 is disposed at the left side of the inside of the housing 2 and in front of the transporting block 300 (see FIG. 2), and has a stationary base plate 30 and a movable base plate 31 (see FIGS. 7 and 8).

In the stationary base plate 30, a planar portion 32 having its principle surface faced horizontally, a bottom edge portion 33 protruding towards the right from the bottom edge of the planar portion 32, a top edge portion 34 protruding towards the left from the top edge of the planar portion 32, and a mechanism mounting portion 35 protruding upwards from the left edge of the top edge portion 34 are integrally formed.

A roller disposition hole 32*a* is formed in a location of the planar portion 32 towards the forward end, and roller mounting portions 32*b* and 32*b* protrude leftwards from the upper edge and the lower edge defining the roller disposition hole 32*a*. A presser roller 36 is supported by the roller mounting portions 32*b* and 32*b*, with a portion of the presser roller 36 protruding rightwards from the roller disposition hole 32*a*. (See FIG. 8.) A spring catch portion 32*c* is provided behind the roller disposition hole 32*a*, on the planar portion 32. A sheet detecting sensor 37 is mounted to a location of the planar portion 32 towards the back end.

A spring insertion hole 34*a* is formed in substantially the forward-and-backward-direction central portion of the top edge portion 34.

Figure 9:
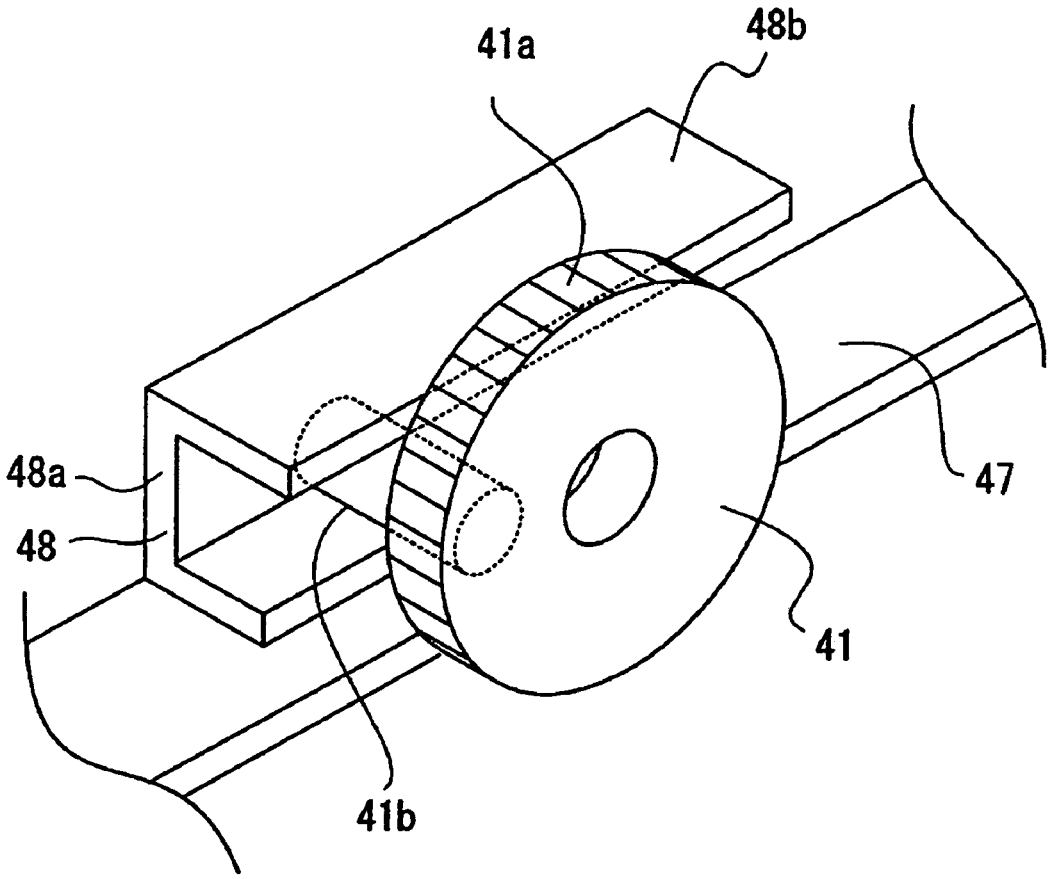
FIG. 9 is an enlarged perspective view showing the relationship between an action portion of the movable base plate and a cam gear.

A moving mechanism 38 is provided on the mechanism mounting portion 35, and comprises a positioning motor 39, a worm gear 40, and a cam gear 41. The positioning motor 39 is mounted to substantially the forward-and-backward direction central portion of the mechanism mounting portion 35, with the worm gear 40 being secured to the shaft of the motor 39. The cam gear 41 is supported by the mechanism mounting portion 35 behind the positioning motor 39, and comprises a geared portion 41*a* and a cam pin 41*b* provided at the outer periphery of the geared portion 41*a* so as to protrude rightwards (see FIG. 9). The geared portion 41*a* of the cam gear 41 engages the worm gear 40.

A position sensor 42 is mounted near the cam gear 41 of the mechanism mounting portion 35. The position sensor 42 detects the position of the cam pin 41*a* when the cam gear 41 has been rotated.

Linking members 43 and 43 are rotatably supported at the front and back ends of the mechanism mounting portion 35, respectively, with one end of each linking member 43 serving as a fulcrum.

The stationary base plate 30 is secured to vertically long shaft members 44 provided inside the housing 2.

The movable,base plate 31 has a planar portion 45 having its principle surface faced horizontally, a positioning edge portion 46 protruding leftwards from the bottom edge of the planar portion 45, and a mounting edge portion 47 protruding leftwards from the top edge of the planar portion 45. The positioning edge portion 46 acts as a positioning portion for positioning the printing sheets at a predetermined position.

A roller insertion hole 45*a* is formed in a location of the planar portion 45 towards the front end.

An action portion 48 is provided at a location of the presser edge portion 47 towards the back end. (See FIGS. 7 and 9.). The action portion 48 has a base end portion 48*a* protruding upward from the presser edge portion 47 and an engaging portion 48*b* protruding leftwards from the top edge of the base end portion 48*a*.

Upwardly protruding supporting portions 49 and 49 are provided on the front and back edges of the presser edge portion 47, respectively. The linking members 43 and 43 are rotatably supported at the respective supporting portions 49 and 49 with the other end of each linking member 43 serving as a fulcrum.

The movable base plate 31 is supported by the shaft member 44 so as to be movable axially, that is, vertically.

As described above, the linking members 43 and 43 are rotatably supported at the mechanism mounting portion 35 of the stationary base plate 30 and the supporting portions 49 of the movable base plate 31. The planar portion 32 of the stationary base plate 30 and the planar portion 45 of the movable base plate 31 are positioned so as to oppose each with a slight gap therebetween (see FIG. 8). The space between the planar portion 32 and the planar portion 45 corresponds to an insertion space 50 for inserting the printing sheets 3000 that have been transported by the transporting block 300.

The bottom edge portion 33 of the stationary base plate 30 is positioned above the positioning edge portion 46 of the movable base plate 31, and the top edge portion 34 of the stationary base plate 30 is positioned below the presser edge portion 47 of the movable base plate 31 (see FIG. 8). The cam pin 41*b* of the cam gear 41 slidably engages the bottom surface of the engaging portion 48*b* of the action portion 48 of the movable base plate 31 (see FIG. 9).

One end of an extension spring 51 is supported at the presser edge portion 47 of the movable base plate 31. The extension spring 51 is inserted in the spring insertion hole 34*a* in the top edge portion 34 of the stationary base plate 30. The other end of the extension spring 51 is supported at the spring catch portion 32*c* of the stationary base plate 30. Therefore, the movable base plate 31 is urged downward with respect to the stationary base plate 30.

In the moving mechanism 38, when the positioning motor 39 is rotated, the driving force thereof is transmitted to the worm gear 40 and the cam gear 41 in that order, causing the cam gear 41 to rotate, so that the position of the cam pin 41*b* changes. When the position of the cam pin 41*b* changes, the movable base plate 31 including the action portion 48 engaging the cam pin 41*b* is guided by the shaft member 44 and moves vertically with respect to the stationary base plate 30.

A rotational drive portion 52 is disposed at the right side of the planar portion 32 of the stationary base plate 30, and comprises a roller rotation motor 52*a* and a gear group 52*b* which is rotated by the roller rotation motor 52*a* (see FIG. 4). One end of a rotary lever 53 is supported at the last gear of the gear group 52*b*, and a vertically long roller shaft 54 is supported at the other end of the rotary lever 53. An intermediate pick-up roller 55 is provided at the axial-direction central portion of the roller shaft 54. (See FIGS. 3, 4, and 8.) The intermediate pick-up roller 55 is provided as intermediate pick-up means for picking up a printing sheet 3000 that has been inserted into the insertion space 50 and sending it towards the printing block 500, and moves substantially horizontally when the rotary lever 53 is rotated by the rotational drive portion 52.

When the intermediate pick-up roller 55 is rotated leftwards, it is inserted into the roller insertion hole 45*a* of the movable base plate 31, and is pushed against the presser roller 36 with the printing sheet 3000 that has been inserted into the insertion space 50 being disposed therebetween in order to send the printing sheet 3000 towards the printing block 500.

The printing block 500 is disposed in front of the positioning block 400 (see FIG. 2), and comprises a head mechanism 56 and a head drive mechanism 57 (see FIGS. 3 and 4).

The head mechanism 56 has a printing head 59 provided at a head supporting member 58. A thermal head for performing printing on the printing sheets 3000 by heat transfer is used as the printing head 59.

The head drive mechanism 57 is positioned at the left side of the head mechanism 56, and comprises a head pressure adjusting member 60, an action member 61, and a head pressure adjusting cam 62. (See FIGS. 10 to 12.)

The head pressure adjusting member 60 is long in substantially the forward-and-backward directions, and is rotatably supported with a rotary shaft 63 positioned at the back end of the head pressure adjusting member 60 serving as a fulcrum. A rightwardly protruding pressure roller 60*a* is supported at the front end of the head pressure adjusting member 60.

The action member 61 is long in substantially the forward-and-backward direction, and is rotatably supported with the rotary shaft 63 at the back end of the action member 61 serving as a fulcrum. The action member 61 is longer than the head pressure adjusting member 60, with its front end being positioned forwardly of the head pressure adjusting member 60. A leftwardly protruding action roller 61*a* is supported at the front end of the action member 61.

A helical compression spring 64 is provided in a compressed state between the head pressure adjusting member 60 and the action member 61. Therefore, the head pressure adjusting member 60 and the action member 61 are biased in directions in which they move away from each other by the helical compression spring 64, that is, the head pressure adjusting member 60 is urged towards the head mechanism 56, and the action member 61 is urged away from the head mechanism 56.

The head pressure adjusting cam 62 is secured to a vertically long rotary shaft 65 rotatably supported inside the housing 2. (See FIG. 4.) The outer peripheral surface of the head pressure adjusting cam 62 is formed into a cam surface 66. With increasing distance from the rotational center of the rotary shaft 65, a standby cam portion 66*a*, a cam portion 66*b* for horizontal setting, and a cam portion 65*c* for vertical setting are formed on the cam surface 66 (see FIGS. 10 to 12). The cam surface 66 of the head pressure adjusting cam 62 is in contact with the action roller 61*a* supported at the action member 61.

A cam position detecting plate 67 is secured at the left side of the head pressure adjusting cam 62. The cam position detecting plate 67 has a substantially disc shape, and has three detecting slits 67*a*, 67*b*, and 67*c* spaced at equal intervals in the peripheral direction.

A platen roller 68 is supported and opposes the printing head 59 of the head mechanism 56. The head mechanism 56 can move away from the platen roller 68.

When the head pressure adjusting cam 62 is rotated as the rotary shaft 65 rotates by a rotary mechanism (not shown), the position of the cam surface 66 with respect to the action roller 61*a* changes, so that the action member 61 rotates with the rotary shaft 63 as the fulcrum. Therefore, when the action member 61 rotates, the rotational force thereof is exerted upon the head pressure adjusting member 60 through the helical compression spring 64, causing the head pressure adjusting member 60 to rotate in the direction in which the pressure roller 60*a* moves away from the head supporting member 58 with the rotary shaft 63 as the fulcrum. In accordance with the pushing force exerted upon the head supporting member 58 by the pressure roller 60*a*, the pressure upon the platen roller 68 by the printing head 59 changes.

The rotary mechanism is operated based on the results provided by state recognizing means (not shown). When the state recognizing means recognizes that the printing block 500 is in a standby mode in which a printing operation on the printing sheets 3000 is not performed, the head pressure adjusting cam 62 is rotated so that the standby cam portion 66*a* comes into contact with the action roller 61*a* (see FIG. 10). When the state recognizing means recognizes that the printer 1 is in a horizontally set mode when a printing operation is to be performed on the printing sheets 3000, the head pressure adjusting cam 62 is rotated so that the horizontal setting cam portion 66*b* comes into contact with the action roller 61*a* (see FIG. 11). When the state recognizing means recognizes that the printer 1 is in a vertically set mode when a printing operation is to be performed on the printing sheets 3000, the head pressure adjusting cam 62 is rotated so that the vertical setting cam portion 66*c* comes into contact with the action roller 61*a* (see FIG. 12).

The recognizing operation by the state recognizing means may be automatically performed using a gravity sensor, may be manually performed by a user by inputting a state, etc.

Figure 10:
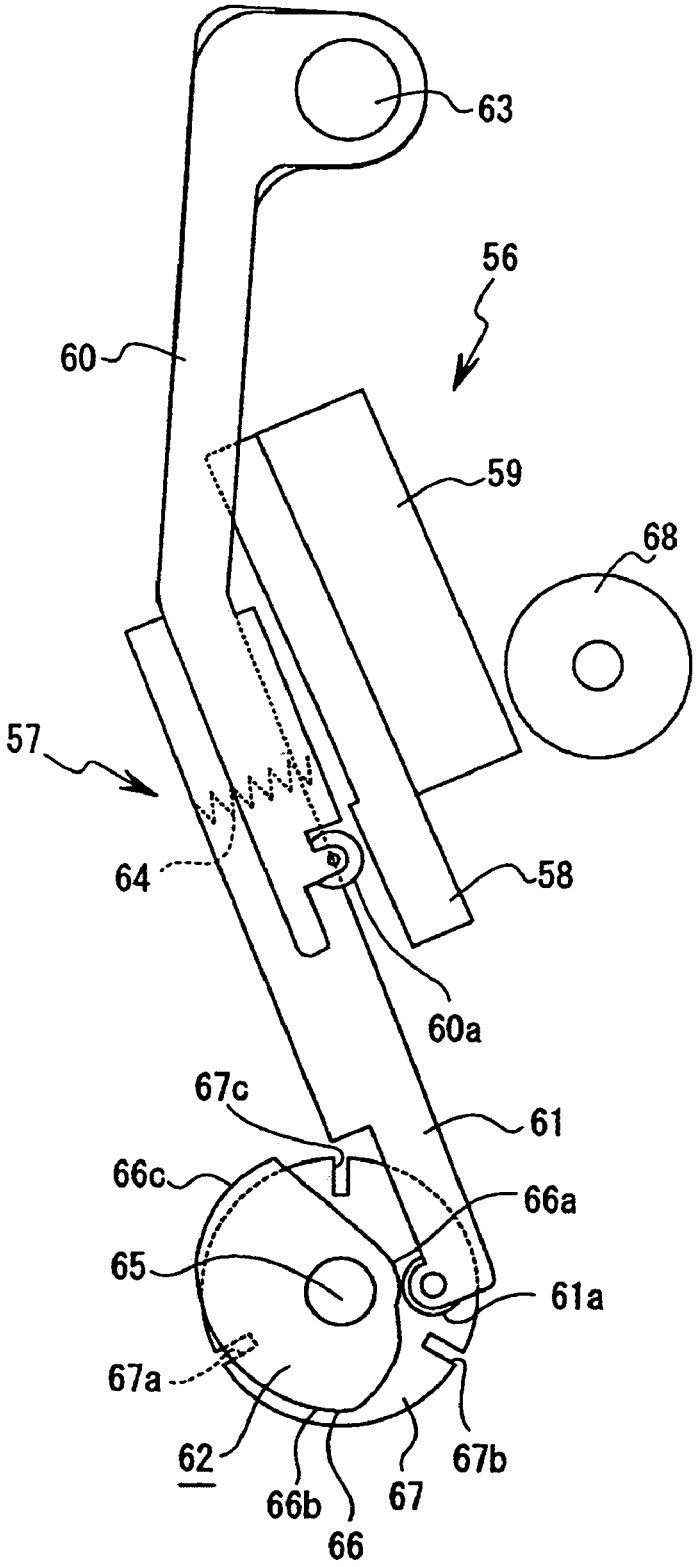
FIG. 10 shows the state of each portion of the printing block along with FIGS. 11 and 12, and is a plan view of each portion of the printing block in a standby mode.

As described above, when the standby cam portion 66*a* is in contact with the action roller 61*a* due to the rotation of the head pressure adjusting cam 62, the detecting slit 67*a* is covered by the head pressure adjusting cam 62, so that a detection is made that the standby cam portion 66*a* is in contact with the action roller 61*a* (see FIG. 10). When the standby cam portion 66*a* is in contact with the action roller 61*a*, the pressure roller 60*a* at the head pressure adjusting member 60 moves away from the head supporting member 58, so that the printing head 59 moves away from the platen roller 68.

Figure 11:
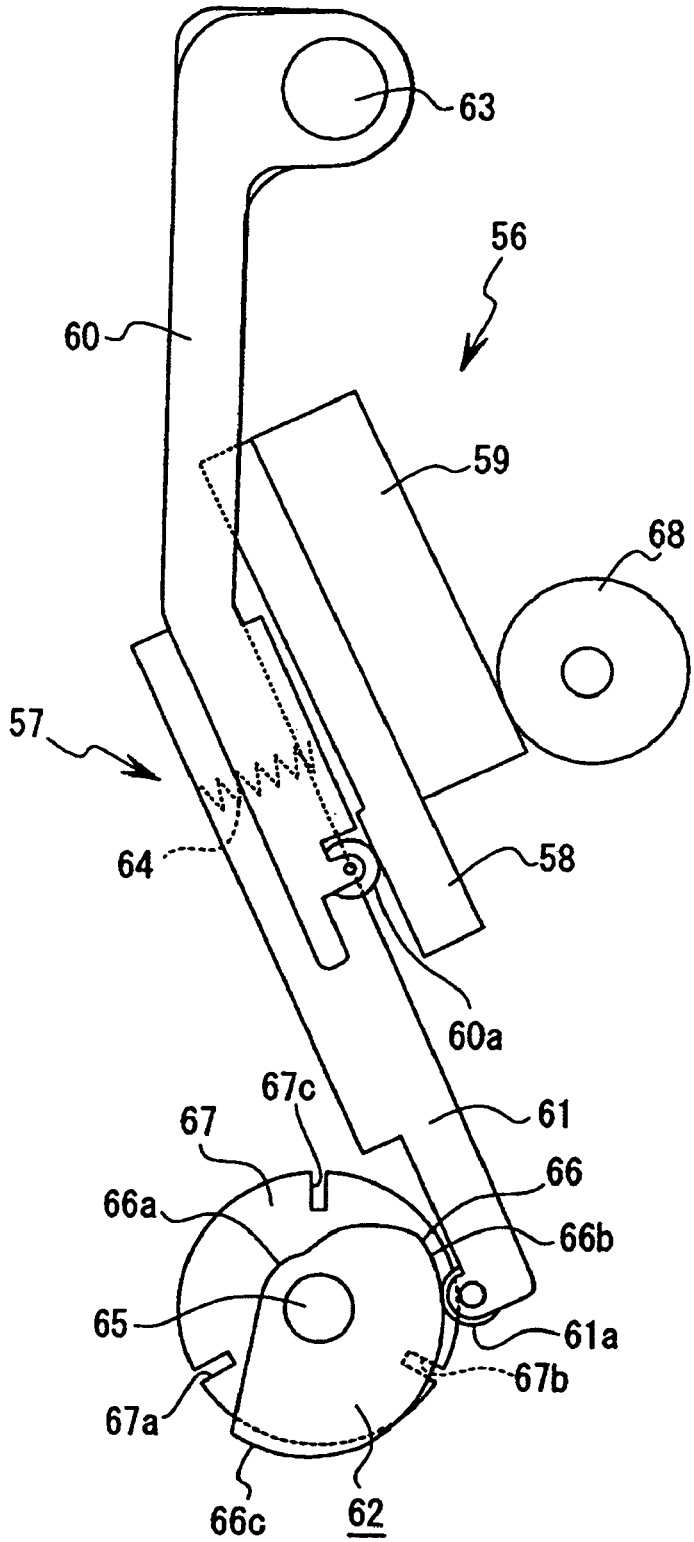
FIG. 11 is a plan view of each portion of the printing block in a horizontally set mode of the printer.

When the horizontal setting cam portion 66*b* is in contact with the action roller 61*a* due to the rotation of the head pressure adjusting cam 62, the detecting slit 67*b* is covered by the head pressure adjusting cam 62, so that a detection is made that the horizontal setting cam portion 66*b* is in contact with the action roller 61*a* (see FIG. 11). When the horizontal setting cam portion 66*b* is in contact with the action roller 61*a*, the head supporting member.58 is pushed by the pressure roller 60*a* at the head pressure adjusting member 60, so that the printing head 59 press-contacts the platen roller 68.

Figure 12:
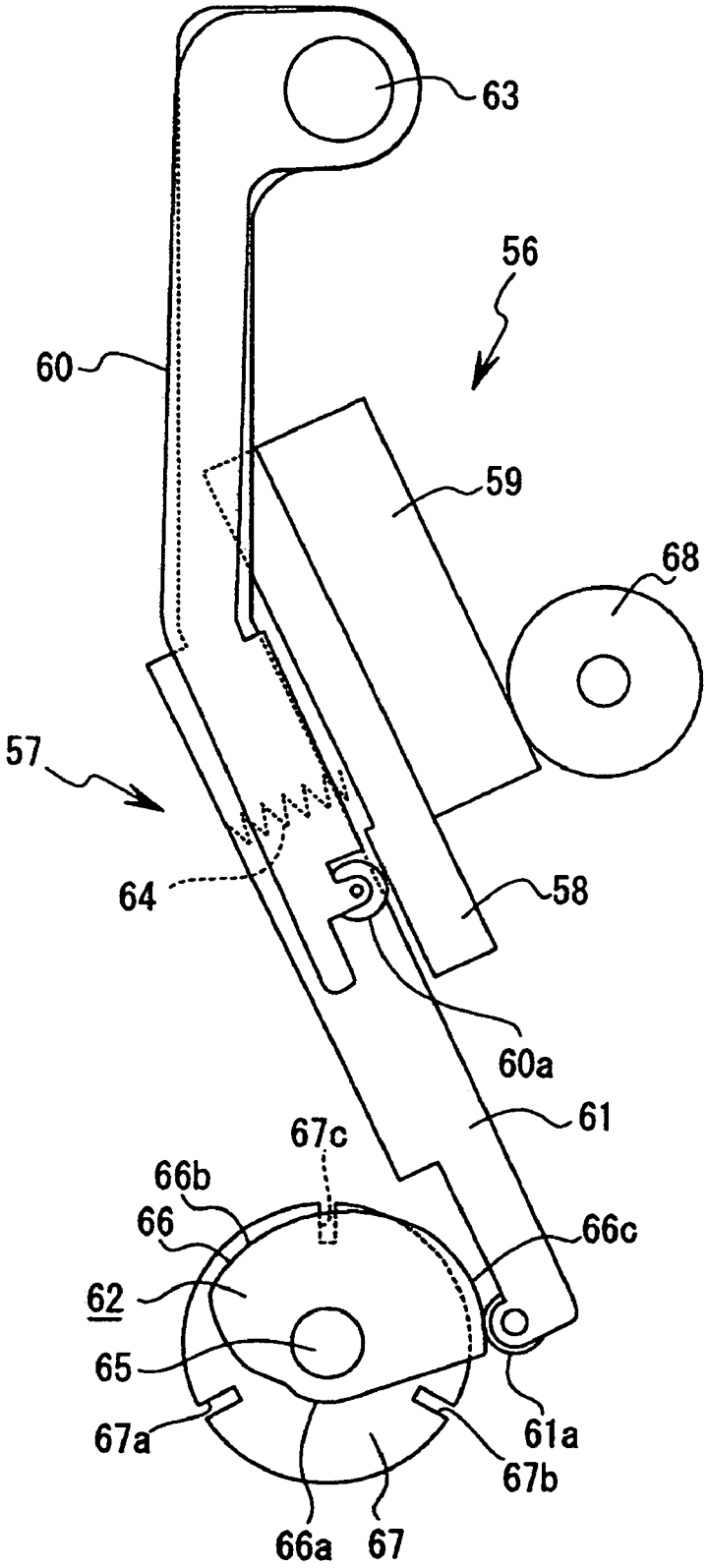
FIG. 12 is a plan view of each portion of the printing block in a vertically set mode of the printer.

When the vertically setting cam portion 66*c* is in contact with the action roller 61*a* due to the rotation of the head pressure adjusting cam 62, the detecting slit 67*c* is covered by the head pressure adjusting cam 62, so that a detection is made that the vertical setting cam portion 66*c* is in contact with the action roller 61*a* (see FIG. 12). When the vertical setting cam portion 66*c* is in contact with the action roller 61*a*, the head supporting member 58 is pushed by the pressure roller 60*a* at the head pressure adjusting member 60, so that the printing head 59 press contacts the platen roller 68. At this time, the printing head 59 is pushed more strongly against the platen roller 68 than when the horizontal setting cam portion 66*b* is in contact with the action roller 61*a*. It is pushed with, for example, 1.5 times the pressure.

Accordingly, comparing the vertical set mode with the horizontal set mode, the pressure exerted upon the platen roller 68 from the printing head 59 by the head drive mechanism 57 is larger. Considering the pressure produced by weight exerted upon the platen roller 68 by the head mechanism 56 when the printer 1 is in the horizontally set mode, a substantially constant pressure is exerted upon the platen roller 68 from the head mechanism 56 in both modes.

Therefore, regardless of whether the printer 1 is in a horizontally or vertically set mode, the printer 1 performs a proper printing operation on the printing sheets 3000 by a constant head pressure.

In the standby mode in which printing is not performed on the printing sheets 3000 by the printing head 59, since a predetermined gap is provided between the printing head 59 and the platen roller 68, undesired contact between the printing head 59 and the platen roller 68 can be prevented, so that it is possible to prevent, for example, wearing thereof, and to properly transport the printing sheets 3000 to the printing block 500.

When a recognizing operation is performed by the state recognizing means, as mentioned above, the pressure exerted upon the platen roller 68 from the printing head 59 is adjusted. At this time, when the printing sheets 3000 are transported to the sheet taking-out block 900 from the sheet-holding block 100, the pressure exerted upon the printing sheets 3000 by each portion pushed against the printing sheets 3000, that is, the pick-up roller 16, the separation rollers 17 and 17, the transportation rollers 25*b* and 26*b*, the intermediate pick-up roller 55, pinch rollers 69 and 69, a first turn-around roller 71, a second turn-around roller 75, a discharging roller 77, etc., is adjusted based on the results of the recognizing operation of the state recognizing means, so that a substantially constant pressure is exerted upon the printing sheets 3000 in both the horizontally set mode and the vertically set mode.

Therefore, a constant pressure is exerted upon the printing sheets 3000 when they are transported regardless of whether the printer 1 is in a horizontally or vertically set mode, so that it is possible to properly transport the printing sheets 3000.

The pinch rollers 69 and 69 and capstans 70 and 70, which the pinch rollers 69 and 69 press contact, are supported at the front and back of the platen roller 68 in the printing block 500 (see FIG. 3).

The first turn-around roller 71 is supported in front of the pinch rollers 69 and 69, and an endless transportation belt 72 press-contacts the first turn-around roller 71. (See FIG. 3.) Rotation of tension rollers 73, which brings the transportation belt 72 under a constant tension, causes the transportation belt 72 to move as the first turn-around roller 72 rotates.

The intermediate transporting block 600 is disposed behind the printing block 500 (see FIG. 2), and has a presser roller 74 (see FIG. 3). The presser roller 74 is supported at a location opposite to the presser roller 36 in the positioning block 400 with the intermediate pick-up roller 55 being disposed between them. When the intermediate pick-up roller 55 is rotated towards the right, the intermediate pick-up roller 55 is pushed against the presser roller 74, so that the printing sheets 3000 can be transported towards the density measuring block 700.

The density measuring block 700 is disposed behind the intermediate transporting block 600 (see FIG. 2), and has a density measuring device (not shown) for measuring the printing density on the printing sheets 3000 transported to the density measuring block 700.

The second turn-around roller 75 is supported in the density measuring block 700. Press-contact rollers 76 and 76, which press-contact the second turn-around roller 75, are supported at opposing locations on both sides of the rotational center of the second turn-around roller 75 (see FIG. 3). The second turn-around roller 75 is rotated by transmission of the driving force of the roller rotation motor 52*a* of the rotational drive portion 52.

The sheet-discharging block 800 is disposed in front of the density measuring block 700 (see FIG. 2), and includes the discharging roller 77 for discharging the printing sheets 3000 and a transportation roller 78 which press-contacts the discharging roller 77 (see FIG. 3).

The sheet taking-out block 900 is disposed at the left side of the sheet-holding block 100 (see FIG. 2), and includes a sheet taking-out space 79 for taking out the printing sheets 3000 that have been discharged by the discharging roller 77 (see FIG. 3).

Fans 80 are spaced apart vertically and disposed towards the left at the front end of the inside of the housing 2.

Hereunder, the transportation of the printing sheets 3000 and the operation of each block in the printer 1 will be described. Hereunder, unless otherwise specified, the operation of the printer 1 in the vertically set mode will be described.

The printing sheets 3000 being stacked with their surfaces faced horizontally are held inside the sheet cassette 3 of the sheet-holding block 100. When the sheet cassette 3 is inserted into the opening 2*a* and mounted to the inside of the housing 2, the printing sheets 3000 can be picked up by the picking-up mechanism 15.

The sheet-holding block 100 has detecting means for detecting the total thickness or the total number of printing sheets 3000 held in the sheet-holding block 100. The adjusting mechanism 8 operates based on the results of detection of the detecting means. When the drive motor 9 of the adjusting mechanism 8 is rotated, as mentioned above, the holding plate 7 moves in a direction opposite to the printing sheets 3000 held in the sheet cassette 3.

Figure 13:
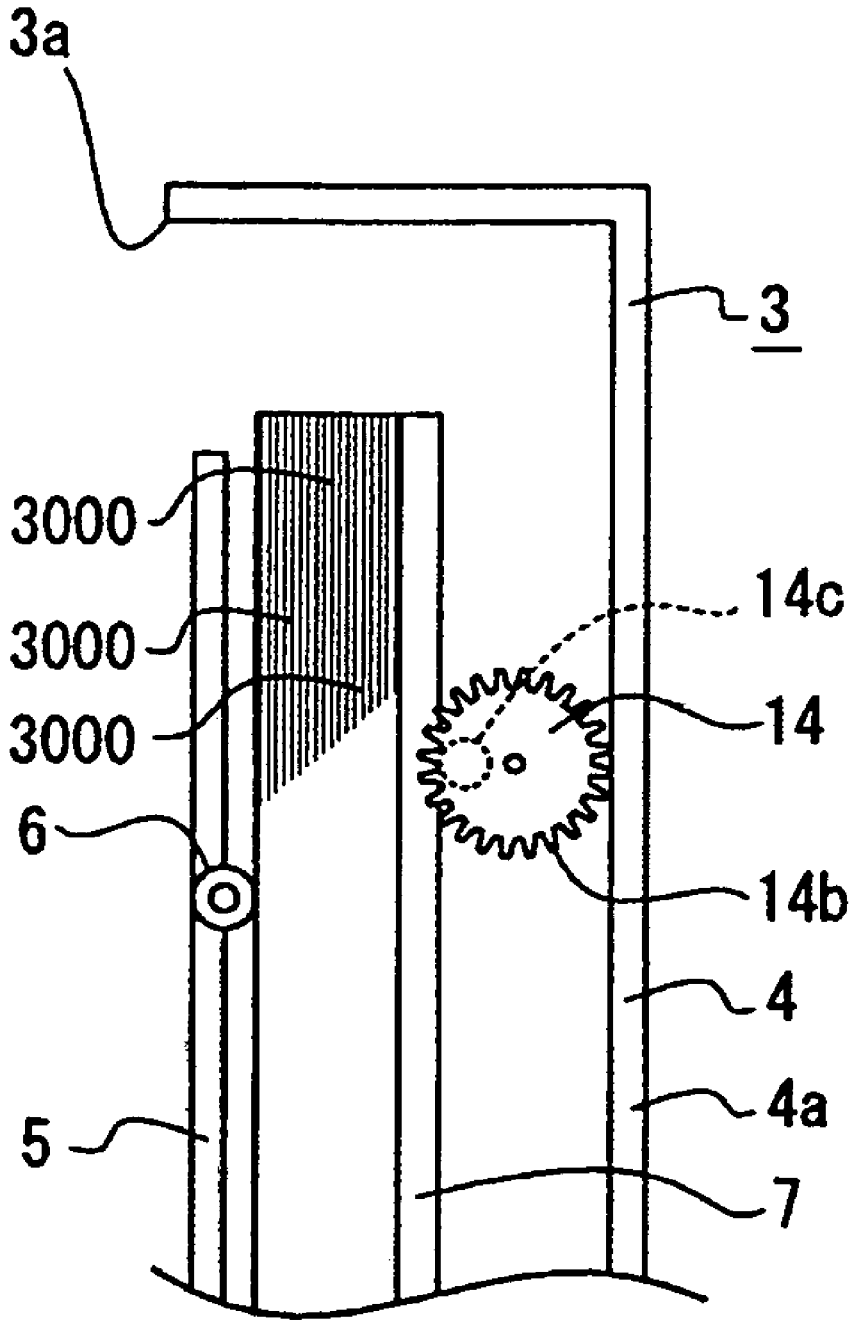
FIG. 13 is a conceptual view showing a state in which the printing sheets are pushed towards a cover member inside the sheet cassette.

When the printing sheets 3000 are not picked up from the sheet cassette 3, the holding plate 7 moves to the side of the printing sheets 3000 held in the sheet cassette 3. By the holding plate 7, the printing sheets 3000 held in the sheet cassette 3 are pushed towards the cover member 5 of the sheet cassette 3, and are brought into contact with the rollers 6 and 6 (see FIG. 13). Therefore, the printing sheets 3000 held inside the sheet cassette 3 are not warped, thereby making it possible to, for example, prevent the printing sheets 3000 from being improperly picked up by the picking-up mechanism 15 of the picking-up block 200 and prevent damage to the printing sheets 3000 when they are picked up.

The printing sheets 3000 are held by the holding plate 7 when the printer 1 is in the horizontally set mode or the vertically set mode. In the vertically set mode, the printing sheets 3000 tend to be warped, so that the holding plate 7 functions particularly effectively in the vertically set mode.

Figure 14:
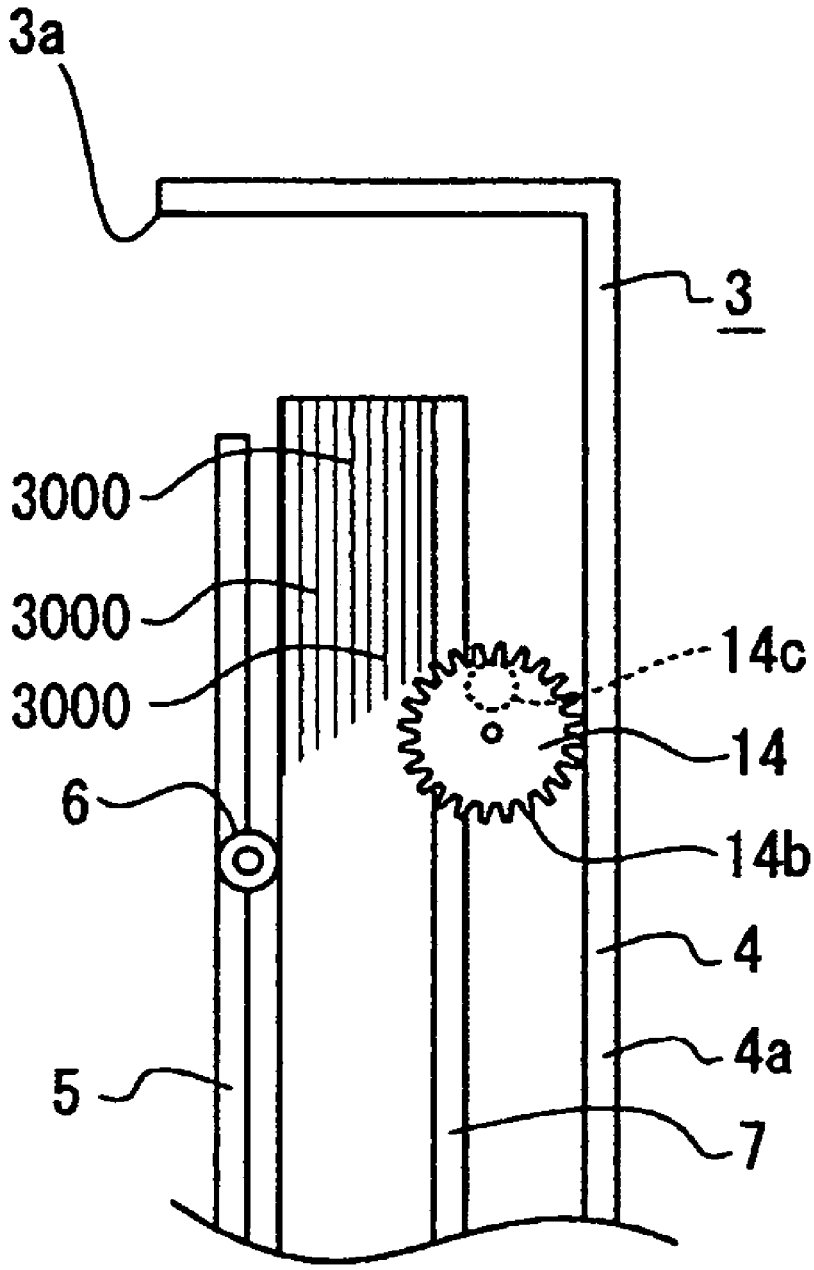
FIG. 14 is a conceptual view showing a state when the printing sheets are to be picked up from the sheet cassette.

On the other hand, when the printing sheets 3000 are picked up from the sheet cassette 3, the adjusting gears 14 are rotated in order to temporarily move the holding plate 7 in the direction opposite to the printing sheets 3000, so that the printing sheets 3000 held in the sheet cassette 3 are no longer pushed towards the cover member 5 of the sheet cassette 3 (see FIG. 14). Therefore, the printing sheets 3000 held inside the sheet cassette 3 are reliably picked up one at a time by the picking-up mechanism 15.

Although, in the printer 1, the holding plate 7 for holding the entire surfaces of the printing sheets 3000 is provided as the holding means, other holding means may be used. For example, two vertically long holding shafts spaced apart in the forward-and-backward direction, that is, in the direction in which the printing sheets 3000 are transported, may be disposed inside the sheet cassette 3 in order to hold portions of the surfaces of the printing sheets 3000. It is desirable that the lengths of the holding shafts be substantially the same as or greater than the vertical widths of the surfaces of the printing sheets 3000.

Accordingly, it is possible to effectively prevent warping of the printing sheets 3000 even by holding them with at least two holding means in the direction in which they are transported.

The printing sheets 3000 are picked up one at a time from the sheet cassette 3 by the pick-up roller 16 of the picking-up block 200, and are transported towards the transporting block 300 by the separation rollers 17 and 17. The printing sheets 3000 which are picked up by the picking-up mechanism 15 each come into contact with the rollers 6 supported at the cover member 5 of the sheet cassette 3. Therefore, since the rollers 6 and 6 are rotated when the printing sheets 3000 are picked up by the picking-up mechanism 15, the printing sheets 3000 can be reliably and easily picked up.

The detection portion 19*a* of the detection member 19 is detected by the roller position sensor 21 when the printing sheets 3000 are picked up, so that the position of the pick-up roller 16 is detected based on the detection results.

The printing sheets 3000 which have been picked up by the picking-up block 200 and transported to the transporting block 300 are transported towards the positioning block 400. In the transporting block 300, the printing sheets 3000 are transported by the transportation rollers 25*b* and the transportation rollers 26*b* in that order.

The printing sheets 3000 transported to the positioning block 400 are inserted one at a time into the insertion space 50 between the stationary base plate 30 and the movable base plate 31. When the printing sheets 3000 are inserted into the insertion space 50, the insertion of each printing sheet 3000 is detected by the sheet detecting sensor 37.

Figure 15:
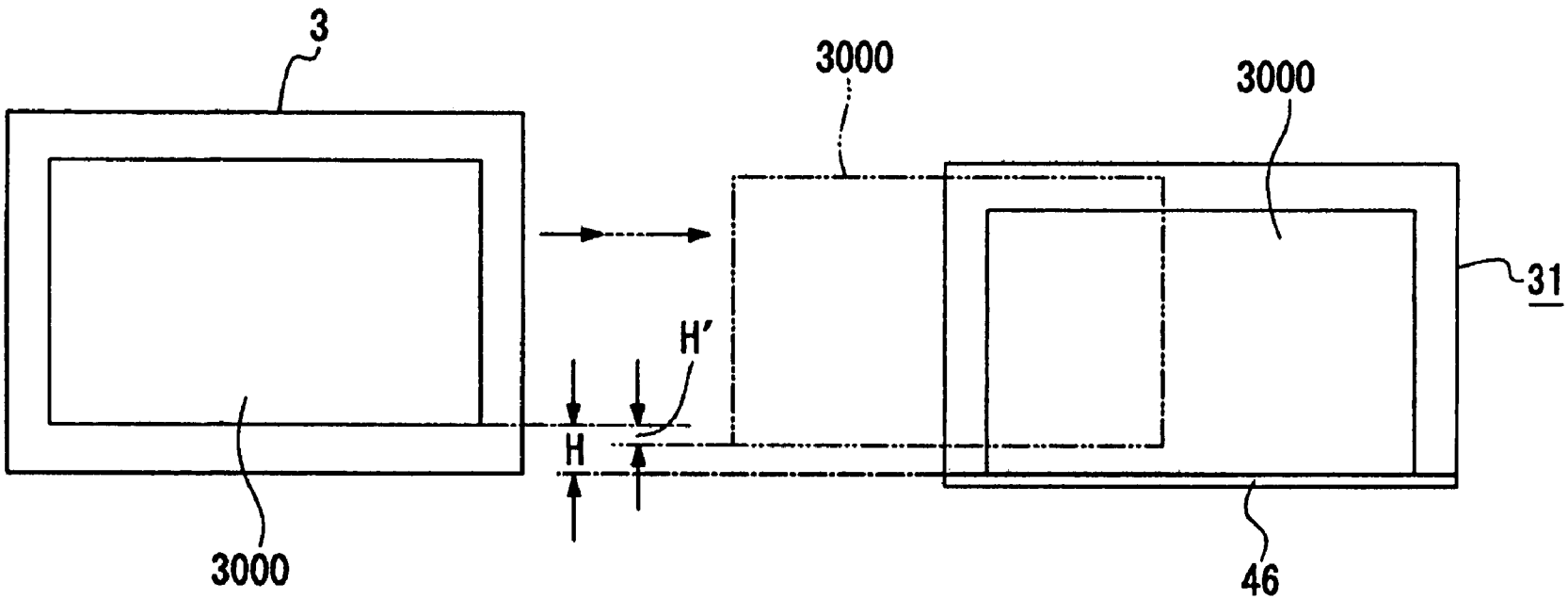
FIG. 15 is a conceptual view showing the relationship between the position of the printing sheets in the sheet-holding block and the position of the printing sheets in the positioning block.

The position of each printing sheet 3000 held in the sheet cassette 3 is shifted upward by a distance H from a predetermined location where each printing sheet 3000 is positioned in the positioning block 400 one at a time (see FIG. 15). The printing sheets 3000 that have been picked up from the sheet cassette 3 are transported to the positioning block 400 through the picking-up block 200 and the transporting block 300. The printing sheets 3000 may be transported to the positioning block 400 while being shifted downward by, for example, H' due to gravity during the transportation of the printing sheets 3000. However, H is larger than the expected shift amount H'. Therefore, when the printing sheets 3000 move downward due to their own weights when they are inserted into the insertion space 50 one at a time, the bottom ends of the printing sheets 3000 inserted in the insertion space 50 one at a time are brought into contact with the positioning edge portion 46 of the movable base plate 31, and are positioned one at a time at the predetermined location (see FIG. 15).

In the printer 1, since the transported printing sheets 3000 are positioned one at a time at the predetermined location in the positioning block 400, the positioning sheets 3000 are each transported to a proper printing location of the printing block 500 from the positioning block 400, so that proper printing can be carried out on the printing sheets 3000 in the printing block 500.

Since the printing sheets 3000 can be positioned in the positioning block 400 by only shifting them upward from the predetermined location in the positioning block 400, the printing sheets 3000 can be easily and reliably positioned.

As mentioned above, the position of each printing sheet 3000 held in the sheet cassette 3 is shifted upward by the distance H from the predetermined positioning location in the positioning block 400 (see FIG. 15). Therefore, in the case where the printer 1 is in the horizontally set mode, when a printing sheet 3000 has been inserted into the insertion space 50, the moving mechanism 38 operates to position the printing sheet 3000 at the predetermined location.

In the case where the printer 1 is in the horizontally set mode, when a printing sheet 3000 is inserted into the insertion space 50, the cam gear 41 is rotated by the rotation of the positioning motor 39, causing the movable base plate 31 to move with respect to the stationary base plate 30, so that the printing sheet 3000 is positioned at the predetermined location. When the cam gear 41 is rotated, its position is detected by the position sensor 42.

Accordingly, even if the printer 1 is in the horizontally set mode, the printing sheets 3000 can be simply and reliably positioned by the moving mechanism 38.

When the positioning of the printing sheet 3000 at the predetermined location in the positioning block 400 is completed, the rotary lever 53 is rotated by the roller rotation motor 52*a*, causing the intermediate pick-up roller 55 to press-contact the presser roller 36 through the printing sheet 3000, so that the printing sheet 3000 is transported towards the printing block 500 by the rotation of the intermediate pick-up roller 55.

When the printing sheet 3000 is transported to the printing block 500, driving the head drive mechanism 57 causes the printing head 59 separated from the plate roller 68 in the standby mode to press-contact the platen roller 68 through the printing sheet 3000 and a recording ribbon (not shown). The printing head 59 scans the printing sheet 3000 transported by the pinch rollers 69 and 69, so that thermal transfer printing is performed on the printing sheet 3000. At this time, as mentioned above, the head pressure adjusting cam 62 rotates, so that the position of the cam surface 66 with respect to the action roller 61*a* changes, thereby changing the pressure exerted upon the platen roller 68 by the printing head 59 in accordance with whether the printer 1 is in the vertically set mode or the horizontally set mode.

After the printing operation on the printing sheet 3000 has been completed, the printing sheet 3000 has its direction of transportation changed by the first turn-around roller 71 and the transportation belt 72, and is transported towards the intermediate transporting block 600.

When the printing sheet 3000 is transported to the intermediate transporting block 600, the roller rotation motor 52*a* is rotated in a direction opposite to the earlier direction. Rotation of the rotary lever 53 causes the intermediate pick-up roller 55 to press-contact the presser roller 74 through the printing sheet 3000, so that the printing sheet 3000 is transported towards the density measuring block 700.

When the printing sheet 3000 is transported to the density measuring block 700, the printing density on the printing sheet 3000 is measured by the density measuring device. When the measurement results show that there are, for example, variations in the printing density, information of such a problem is displayed on a display section (not shown) on the housing 2.

The printing sheet 3000 has its direction of transportation changed by the second turn-around roller 75 and the press-contact rollers 76 and 76, and is transported towards the sheet discharging block 800.

The-printing sheet 3000 that has been transported to the sheet-discharging block 800 is transported to the sheet taking-out space 79 of the sheet taking-out block 900 by the discharging roller 77 and the transportation roller 78, whereby the transportation of the printing sheet 3000 is completed.

The specific forms and structures of each portion in the above-described embodiment are only practical examples in carrying out the present invention, so that these are not to be construed as limiting the technical scope of the present invention.

As is clear from the foregoing description, a printer of the present invention comprises a sheet-holding block which can hold a plurality of printing sheets in a stack; a picking-up block for picking up the printing sheets held in the sheet-holding block one at a time; a transporting block for transporting the printing sheets picked up by the picking-up block; a printing block for performing printing on the printing sheets transported by the transporting block; and a sheet-discharging block for discharging the printing sheets that have been subjected to printing at the printing block. In the printer, the blocks are disposed inside a housing. A positioning block is disposed between the transporting block and the printing block and positions the printing sheets transported by the transporting block at a predetermined location of the positioning block one at a time, so that they are positioned one at a time at a printing location of the printing block where each printing sheet is subjected to printing. Intermediate picking-up means for picking up the printing sheets positioned at the predetermined location of the positioning block one at a time in order to transport the printing sheets to the printing block is provided.

Therefore, each of the printing sheets is transported to the proper printing location of the printing block from the positioning block, so that it is possible to perform proper printing on the printing sheets at the printing block.

In one form, the positioning block comprises a stationary base plate secured with respect to the housing, a movable base plate positioned opposing the stationary base plate, being orthogonal to the stationary base plate in the direction in which the printing sheets are transported, and being capable of moving in the direction of the surfaces of each printing sheet, and a moving mechanism for moving the movable base plate with respect to the stationary base plate. Here, an insertion space is provided between the stationary base plate and the movable base plate for inserting each printing sheet that has been transported by the transporting block. When one printing sheet has been inserted into the insertion space, the movable base plate is moved with respect to the stationary base plate by the moving mechanism in order to position the printing sheet at the predetermined location. Therefore, it is possible to simply and reliably position the printing sheets by the moving mechanism.

In another form, the printing sheets are transported from the sheet-holding block to the sheet-discharging-block with their surfaces faced horizontally, the position of each printing sheet held in the sheet-holding block is set above the predetermined location of each printing sheet of the positioning block; and a positioning portion for positioning the printing sheets at the predetermined location one at a time by receiving the printing sheets that have been transported to the positioning block and that have moved downward due to their weights is provided. Therefore, it is possible to easily and reliably position the printing sheets.

A printer comprises a sheet-holding block which can hold a plurality of printing sheets in a stack; a picking-up block for picking up the printing sheets held in the sheet-holding block one at a time; a transporting block for transporting the printing sheets picked up by the picking-up block; a printing block for performing printing on the printing sheets transported by the transporting block; and a sheet-discharging block for discharging the printing sheets that have been subjected to printing at the printing block. The sheet-holding block comprises a sheet-receiving plate for receiving one of the surfaces of each printing sheet held in the sheet-holding block, and holding means, disposed opposing the sheet-receiving plate and moving away from the sheet-receiving plate depending upon the thickness of the printing sheets held in the sheet-holding block, for holding the other surface of each printing sheet held in the sheet-holding block, the other surface being opposite to the one surface.

Therefore, the printing sheets held inside the sheet-holding block are not warped, so that it is possible to, for example, prevent damage to the printing sheets when they are picked up and prevent the printing sheets from being improperly picked up by the picking-up block.

In one form, when the printing sheets held in the sheet-holding block are picked up by the picking-up block, the holding means is moved in a direction opposite to the other surfaces of the printing sheets, and, when the printing sheets held in the sheet-holding block are not picked up by the picking-up block, the holding means is moved to the side of the other surfaces of the printing sheets and holds the printing sheets. Therefore, it is possible to reliably pick up the printing sheets held in the sheet-holding block one at a time by the picking-up block.

In another form, the sheet-receiving plate has a roller provided thereat that contacts the printing sheets held by the holding means. Therefore, the roller is rotated when the printing sheets are picked up by the picking-up block, so that it is possible to reliably and easily pick up the printing sheets.

The printing sheets may be transported from the sheet-holding block to the sheet-discharging block with their surfaces faced horizontally. Therefore, it is possible to effectively prevent warping of the printing sheets in a state in which they tend to warp.

The holding means may hold at least two locations of the printing sheets that are separated in the direction in which the printing sheets are transported, and the size of the holding means in the vertical direction may be substantially equal to or the widths of the printing sheets in the vertical direction. Therefore, it is possible to effectively prevent warping of the printing sheets.

A printer comprises a sheet-holding block which can hold a plurality of printing sheets in a stack; a picking-up block for picking up the printing sheets held in the sheet-holding block one at a time; a transporting block for transporting the printing sheets picked up by the picking-up block; a printing block for performing a printing operation on the printing sheets by scanning the printing sheets by a printing head pushed against a platen roller with the printing sheets transported by the transporting block being interposed between the printing head and the platen roller one at a time; and a sheet-discharging block for discharging the printing sheets subjected to printing at the printing block. The printer can be set vertically so that the printing sheets are transported with their surfaces faced horizontally, and can be set horizontally so that the printing sheets are transported with their surfaces faced vertically. The printer further comprises state recognizing means for recognizing the vertically set state or the horizontally set state. When the printing sheets are transported from the sheet-holding block to the sheet-discharging block, the pressure exerted upon the printing sheets by each component part pushed against the printing sheets is made substantially constant in accordance with the results of the recognizing operation of the state recognizing means.

Therefore, a constant pressure is exerted upon the printing sheets being transported regardless of whether the printer is set vertically or horizontally, so that the printing sheets can be properly transported.

In one form, the printer further comprises head pressure adjusting means for causing the pressure exerted upon the printing sheets by the printing head when the printing sheets are subjected to printing to be substantially constant in accordance with the results of the recognizing operation of the state recognizing means. Therefore, it is possible to perform a proper printing operation on the printing sheets under a constant head pressure regardless of whether the printer is set horizontally or vertically.

In another form, a predetermined gap is provided between the printing head and the platen roller when printing is not performed on the printing sheets by the printing head. Therefore, undesired contact between the printing head and the platen roller can be prevented, so that it is possible to prevent, for example, wearing thereof, and to properly transport the printing sheets to the printing block.

What is claimed is:

1. A printer comprising:

a sheet-holding block which can hold a plurality of printing sheets in a stack;

a picking-up block for picking up the printing sheets held in the sheet-holding block one at a time;

a transporting block for transporting the printing sheets picked up by the picking-up block;

a printing block for performing printing on the printing sheets transported by the transporting block; and a sheet-discharging block for discharging the printing sheets that have been subjected to printing at the printing block;

wherein the sheet-holding block comprises a sheet-receiving plate, and movable holding means disposed opposing the sheet-receiving plate, such that said printing sheets are disposed between the sheet-receiving plate and the movable holding means, and wherein the movable holding means can be moved towards or away from the sheet-receiving means, such that said printing sheets are held in tension, thereby avoiding or reducing deformation of said sheets, wherein, when the printing sheets held in the sheet-holding block are picked up by the picking-up block, the moveable holding means is moved in a direction opposite the sheet-receiving plate and wherein, when the printing sheets held in the sheet-holding block are not being picked up by the picking-up block, the moveable holding means is moved toward the sheet-receiving plate and thereby holds the printing sheets in tension, and wherein the sheet-receiving plate has a roller provided thereat that contacts the printing sheets held in the holding block.

* * * * *